US005843874A

United States Patent [19]

Macpherson et al.

[11] Patent Number: 5,843,874

[45] Date of Patent: Dec. 1, 1998

[54] CLEAN PERFORMING GEAR OILS

[75] Inventors: Ian Macpherson, Richmond; Lee D. Saathoff, Glen Allen; Marsha J. Lester, Richmond, all of Va.

[73] Assignee: Ethyl Corporation, Richmond, Va.

[21] Appl. No.: 80,363

[22] Filed: Feb. 27, 1998

Related U.S. Application Data

[63] Continuation-in-part of Ser. No. 662,396, Jun. 12, 1996, abandoned.

[51] Int. Cl.[6] ..... C10M 145/14; C10M 149/06

[52] U.S. Cl. ..... 508/470; 508/469

[58] Field of Search ..... 508/470, 469

[56] References Cited

U.S. PATENT DOCUMENTS

| | | | |
|---|---|---|---|
| 3,816,315 | 6/1974 | Morduchowitz et al. . | |
| 4,164,475 | 8/1979 | Schieman | 252/46.7 |
| 4,606,834 | 8/1986 | Hart et al. . | |
| 4,801,390 | 1/1989 | Robson | 252/25 |
| 4,941,985 | 7/1990 | Benfaremo et al. . | |
| 5,013,468 | 5/1991 | Benfaremo . | |
| 5,013,470 | 5/1991 | Benfaremo . | |
| 5,070,131 | 12/1991 | Rhodes et al. . | |
| 5,112,509 | 5/1992 | Brink, Jr. et al. . | |
| 5,176,840 | 1/1993 | Campbell et al. | 252/49.6 |
| 5,225,093 | 7/1993 | Campbell et al. | 252/51.005 |
| 5,312,884 | 5/1994 | Gore et al. | 526/328 |
| 5,358,650 | 10/1994 | Srinivasan et al. | 252/45 |
| 5,360,562 | 11/1994 | Chrisope et al. | 252/46.6 |
| 5,425,888 | 6/1995 | Santambrogio | 252/51.005 |
| 5,440,000 | 8/1995 | Shirodkar et al. . | |
| 5,454,962 | 10/1995 | Slama et al. | 252/51.5 A |
| 5,484,542 | 1/1996 | Cahoon et al. . | |
| 5,571,445 | 11/1996 | Srinivasan et al. . | |
| 5,622,924 | 4/1997 | Sakai et al. . | |
| 5,665,685 | 9/1997 | Takigawa . | |

FOREIGN PATENT DOCUMENTS

| | | |
|---|---|---|
| 0 436 872 B1 | 9/1993 | European Pat. Off. . |

*Primary Examiner*—Jacqueline V. Howard

*Attorney, Agent, or Firm*—Dennis H. Rainear; Thomas Hamilton

[57] ABSTRACT

A clean performing gear oil for use in transmission oils and axle lubricants is provided. The gear oil having a Brookfield Viscosity at −12° C. ranging from about 1,000 to about 150,000 cP, comprises a base oil having a kinematic viscosity at 100° C. ranging from about 4.0 to about 41.0 cSt. Combined with the base oil is preferably a dispersant pour point depressant and/or a dispersant viscosity index improver. In a further preferred embodiment, the gear oil is essentially devoid of carboxylic-type ashless dispersants (e.g., succinimide dispersants) and Mannich base dispersants, thus realizing a cost saving over conventional gear oils which are used as transmission and axle lubricants. Functionalized polymethylacrylates (PMA) are disclosed as agents that improve the properties of the gear oil and allow for the omission of conventional dispersants.

36 Claims, No Drawings

CLEAN PERFORMING GEAR OILS

RELATED U.S. APPLICATION DATA

This application is a continuation-in-part of application Ser. No.: 08/662,396 filed Jun. 12, 1996, now abandoned.

TECHNICAL FIELD

This invention relates to the use of functionalized alkyl (meth)acrylate polymers in gear oil formulations. Gear oils according to the invention have excellent dispersancy properties, acceptable pour points, and excellent viscosity stability.

BACKGROUND OF THE INVENTION

This invention relates to gear oils for use as transmission oils and in rear axles. More particularly, this invention relates to gear oils having a good cleanliness performance in transmission and axle applications.

Gear oils are different from other lubricants (i.e., crankcase oil, hydraulic oils, automatic transmission fluids and the like) as the conditions experienced in manual transmissions (gear boxes) and axles are extreme. One major difference in the composition of gear oils from other lubricants is the presence of extreme pressure agents. These extreme pressure agents contain high levels of sulfur which are unacceptable in other lubricants due to oxidation problems. Further, gear oils are preferably free of the metals boron and zinc, which also sets them apart from other lubricants.

Although a substantial number of gear oils have been produced having various needed properties where such gear oils are used, there exists a need for an additive or a combination of additives to provide an improved clean performing gear oil that can be used, e.g., in transmission oils and axle lubricants to reduce the deposits (i.e., build-up of sludge and other unwanted materials on metal surfaces). While acceptable performance of the gear oil is a requirement, it is also highly desirable that the additive or additives be low in cost and easily produced.

Original equipment manufacturers desire lubricants having extended "drain capabilities" whereby their customers can operate the equipment for longer periods of time or for greater distances before draining the transmission or gear box of lubricant and replacing it with fresh lubricant. In view of the competitive situations in which they operate, lubricant manufacturers are also desirous of having the ability to provide low cost lubricants having these prolonged service capabilities. The invention realizes this cost savings through the omission of the costly carboxylic-type-type ashless dispersants and the Mannich base dispersants.

Actual drainage periods utilized will depend, to a large extent, upon the type of severity of service and the design of the equipment. The present invention will allow under certain circumstances extended drainage intervals for many axle and transmission applications.

U.S. Pat. Nos. 5,176,840 and 5,225,093 to Campbell et al. disclose a gear oil additive package that includes: (1) an oil soluble succinimide of the formula:;

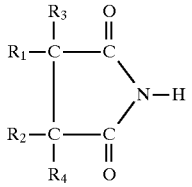

and (2) a boronated or non-boronated carboxylic-type-type derivative composition produced by reacting a substituted succinic acylating agent with an amine and/or an alcohol. These patents also disclose that other components well known in the gear oil art can be added to the formulation. These other components include extreme pressure and anti-wear agents, defoamers, demulsifiers, antioxidants, dyes, pour point depressants and diluents. These references do not suggest or disclose an improved gear oil that is essentially devoid of carboxylic-type-type ashless dispersants such as the succinimides and Mannich base dispersants. The gear oil according this invention collectively contains from 0.1 to about 10 percent by weight of a functionalized poly(meth) acrylate (PMA) having dispersant pour point depressant (DPPD) properties and/or dispersant viscosity index improving (DVII) properties.

U.S. Pat. No. 5,358,650 to Srinivasan et al. discloses an all-synthetic gear oil composition that comprises a base oil and a number of components such as organic sulfur-containing antiwear and/or extreme pressure agents, an organic phosphorus-containing anti-wear and/or extreme pressure agent, a copper corrosion inhibitor, a rust inhibitor, a foam inhibitor and an ashless dispersant such as the Mannich base dispersants or the polyamine succinimides. This reference fails to suggest that the use of a functionalized PMA that can improve the performance of a gear oil and preferably eliminate the need for the inclusion of Mannich base dispersants and succinimide dispersants. U.S. Pat. No. 5,571,445 also to Srinivasan et al. discloses a gear oil lubricant that is essentially halogen and metal free. This patent teaches the required presence of at least one oil-soluble ashless dispersant but does not disclose the functionalized PMA's taught herein.

U.S. Pat. No. 5,484,542 to Cahoon et al. discloses the use of sulfurized overbased products which are thermally stable and are useful as extreme pressure (EP) and/or anti-wear agents for use in gear lubricants and cutting fluids. Cahoon et al. teaches that multi-grade lubricants may include a minor viscosity improving amount of a viscosity improver such as polyolefins or polybutylene; rubbers such as styrene-butadiene or styrene-isoprene; or polyacrylates such as polymethacrylates. In addition to the numerous components taught by this reference, pour point depressants such as polymethacrylate, polyacrylamides and the like are suggested for the inclusion in the lubricating oil. Dispersants, such as the succinimides, ester type and the like are also suggested for inclusion of the lubricating oil. This reference fails to suggest the specific functionalized PMA's disclosed herein for use in gear oil formulations.

U.S. Pat. No. 3,816,315 to Morduchowitz et al. discloses polymers from acrylic and methacrylic acid that are viscosity index improvers (VII) and also function as detergent-dispersants and pour depressants. Specifically, this reference discloses an interpolymer of dialkylaminoalkylmethacrylate, styrene or alkyl substituted styrene, $C_{10}$–$C_{14}$ alkylmethacrylate and $C_{16}$–$C_{20}$ alkylmethacrylate. This patent does not disclose the specific functionalized PMA of this invention for use in gear oil formulations. The teachings of U.S. Pat. No. 4,164,475 to Schieman also fail to suggest or disclose the present invention, as the Schieman patent relates to an alkyl methacrylate copolymer which has been grafted with a dialkyl amino methacrylate monomer.

U.S. Pat. No. 4,801,390 discloses a lubricating composition containing at least one nitrogen-containing, borated ashless dispersant and from 5–20 percent by weight of at least one dispersant viscosity improver.

U.S. Pat. Nos. 4,606,834; 4,941,985; 5,013,468; 5,013,470; 5,112,509; and 5,440,000 all describe functionalized PMA's that have antioxidant, viscosity improving and/or pour depressancy properties. These patents fail to suggest the use of the functionalized PMA's disclosed herein in a gear oil formulation, and also fail to suggest that the gear oils may essentially be devoid of carboxylic-type-ashless dispersant and Mannich base dispersants. These references also fail to disclose functionalized PMA's that are shear resistant.

Many polymers are known to be useful as viscosity index improvers (VII's) for motor oils, however, these motor oil VII's are not acceptable as gear oil VII's due to their low shear stability. U.S. Pat. No. 5,425,888 to Santambrogio et al. discloses a dispersant viscosity index improver (DVII) capable of lowering the pour point of lubricating oil. The DVII of the '888 patent is prepared by reacting a polyolefinic copolymer and a mixture of $C_8$–$C_{25}$ alcohol (meth) acrylates and (meth) acrylic acid in a first step and then condensing the modified copolymer with a polyamine. Representative of the polyamines used in this patent is triethylenetetramine.

U.S. Pat. Nos. 5,622,924 and 5,665,685, both assigned to Sanyo Chemical Industries, Ltd., of Kyoto, Japan, disclose functionalized PMA's with pour point depressant (PPD) and VII properties. The '924 patent teaches that the PMA contain at least 70 percent by weight of a (meth)acrylate monomer containing not more than 10 carbon atoms in the alkyl group. The '685 patent teaches 1–8 percent by weight of the functionalized PMA be monomer unites of N,N-dialkylaminoalkyl acrylate or N,N-dialkylaminoalkyl methacrylate.

SUMMARY OF THE INVENTION

In its broadest concept, the present invention relates to a gear oil having an improved cleanliness performance comprising:

a) a base oil having a kinematic viscosity at 100° C. ranging from about 4.0 to about 41.0 cSt and a Viscosity Index ranging from about 60 to about 140;

b) a dispersant pour point depressant and/or a dispersant Viscosity Index improver; and c) at least one gear performance additive said gear oil having a Brookfield Viscosity at −12° C. ranging from about 1,000 to about 150,000 cP.

In a preferred embodiment, the gear oil according to the invention is essentially devoid of conventional carboxylic-type-type ashless dispersants and Mannich base dispersants.

From an alternative point of view, this invention relates to a gear oil comprising:

a) a base oil having a kinematic viscosity at 100° C. ranging from about 4.0 to about 41.0 cSt and a viscosity Index ranging from about 60 to about 140; and b) about 0.1 to about 10 percent by weight of a polymer comprising the following monomers:

(i) a C1–C6 alkylmethacrylate of the formula:

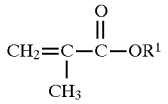

where $R^1$ is alkyl of 1 to 6 carbon atoms;

(ii) a C7–C14 alkylmethacrylate of the formula:

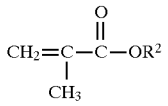

where $R^2$ is alkyl of 7 to 14 carbon atoms;

(iii) a C15–C20 alkylmethacrylate of the formula:

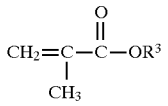

where $R^3$ is alkyl of 15–20 carbon atoms; and (iv) a N,N-dialkylaminoalkyl(meth)acrylamide of the formula:

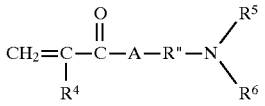

where $R^4$ is hydrogen or a lower alkyl group; $R^5$ or $R^6$ may be hydrogen or a hydrocarbon selected from the group consisting of alkyl, aralkyl, cycloalkyl, aryl and alkaryl, including such radicals when inertly substituted; R" is a hydrocarbon group selected from the group consisting of alkylene, aralkylene, cycloalkylene, arylene and alkarylene, including such radicals when inertly substituted; A is selected from —O—, —S— and —NH—; and c) at least one gear performance additive.

In the above formula, (iv), when $R^5$ or $R^6$ is alkyl, it may typically be methyl, ethyl, n-propyl, isopropyl, n-butyl, isobutyl, sec-butyl, amyl, octyl, decyl, octadecyl and the like. When $R^5$ or $R^6$ is aralkyl, it may typically be benzyl, beta-phenylethyl and the like. When $R^5$ or $R^6$ is aralkyl, it may typically be benzyl, beta-phenylethyl, and the like. When $R^5$ or $R^6$ is cycloalkyl, it may typically be cyclohexyl, cycloheptyl, cyclooctyl, 2-methylcycloheptyl, 3-butylcyclohexyl, 1,3-methylcyclohexyl, and the like. When $R^5$ or $R^6$ is alkaryl, it may typically be tolyl, xylyl, and the like. $R^5$ or $R^6$ may be inertly substituted, i.e., it may bear a non-reactive substituent such as alkyl, aryl, cycloalkyl, ether, and the like. Typically, inertly instituted $R^5$ or $R^6$ groups may include 2-ethoxyethyl, carboethoxymethyl, 4-methyl cyclohexyl, and the like. The preferred $R^5$ or R6 groups may be lower alkyl, i.e., C1–C10 alkyl groups including e.g., methyl, ethyl, n-propyl, i-propyl, butyls, amyls, hexyls, octyls, decyls, and the like.

As disclosed above, R" may be a hydrocarbon group selected from the group consisting of alkylene, aralkylene, cycloalkylene, arylene and alkarylene, including such radicals when inertly substituted. When R" is alkylene, it may typically be methylene, ethylene, n-propylene, isopropylene, n-butylene, i-butylene, sec-butylene, octylene, decylene, octadecylene, and the like. When R" is aralkylene, it may typically be benzylene, beta-phenylethylene, and the like. When R" is cycloalkylene, it may typically be cyclohexylene, cycloheptylene, cyclooctylene, 2-methylcycloheptylene, 3-butylcyclohexylene, 3-methylcyclohexylene, and the like. R" may be inertly substituted, i.e., it may bear a non-reactive substituent such as alkyl, aryl, cycloalkyl, ether, and the like. Typically, inertly substituted R" groups may include 2-ethoxyethylene, carboethoxymethylene, 4-methyl cyclohexylene, and the like. The preferred R" groups may be lower alkylene, i.e., C1–C10 alkylene, groups including e.g., methylene, ethylene, n-propylene, i-propylene, butylene, amylene, hexylene, octylene, decylene, and the like. R" is preferably propylene (—CH2CH2CH2—).

In the above formula (iv), A may be —O—, —S— or preferably —NH—. Representative of the compounds of iv) include N,N-dimethylaminopropylmethacrylamide, N,N-diethylaminopropylmethacrylamide and N,N-dimethylaminoethylacrylamide.

The functionalized PMA used in the gear of this invention will consist of between 0 to about 50 percent by weight of said C1–C6 alkyl methacrylate; between about 30 to about 85 percent by weight of said C7–C14 alkylmethacrylate; between about 3 to about 35 percent by weight of said C15–C20 alkylmethacrylate and about 2 to about 10 percent by weight of said N,N-dialkylaminoalkyl(meth)acrylamide.

The gear oil according to this invention is preferably free of the commonly known carboxylic-type ashless dispersants (i.e., no succinic dispersants) and the Mannich base dispersants. Without these common dispersants, costs associated with the production of the inventive gear oil are reduced and surprisingly without sacrificing the clean performance of the gear oils.

Representative of the functionalized PMA's that are useful in the gear oil according to this invention are HiTEC® 5710, HiTEC® 5712, HiTEC® 5707 and HiTEC® 5774, all marketed by the Ethyl Corporation of Richmond, Va. As used herein, the term "functionalized PMA" means a PMA that has dispersancy properties.

The gear oil according to this invention will contain at least one gear performance additive which will impart to the gear oils properties such as antiwear, extreme pressure performance, rust control, corrosion inhibition, foam inhibition, water separation and the like.

The base oil used in a gear oil according to this invention will have a flash point temperature ranging from about 200° to about 700° F. The finished gear oil (all components added) will have a flash point temperature ranging from about 300° to about 570° F. As used herein and in the claims, the term "base oil" refers to one oil or a mixture of oils to obtain the desired viscosity characteristics.

In addition, the invention provides, interalia, low cost gear lubricants and gear lubricant additive packages that provide prolonged effective service life. In some cases, operation for at least 100,000 miles without replacement of the gear box and/or axle lubricant is possible. The invention also relates to methods for reducing the sludge production in a lubricated gear box (i.e., an automotive manual transmission) or axles, the method comprising the placement of a gear oil according to this invention in the gear box or axles. In similar fashion, the present invention discloses a method for reducing carbon and varnish production in a gear box or axle.

In preferred embodiments, lubricants are provided which are useful as transmission oils for heavy duty service, or as axle oils, and as gear oils for all types of service including heavy duty service. As used herein and in the claims, the term "gear oil" excludes oils used in automatic transmissions, internal combustion engines (crankcase oil) and hydraulic fluids. Further, the gear oils according to the invention contain at least one metal free, sulfur containing extreme pressure agent that is at least 25 percent by weight sulfur. The amount of sulfur from the metal free, sulfur containing extreme pressure agent present in the finished gear oil will be from 1,000 to 30,000 ppm, more preferably from 10,000 to 25,000 ppm and most preferably from 15,000 to 25,000 ppm.

Moreover, this invention makes it possible to provide so-called "total driveline" lubricants whereby the same lubricant composition can be used for the operation of both the transmission and the axle or differential gearing system. Additionally, the invention enables the achievement of the foregoing advantages with lubricants which are free of metal-containing additive components in that the lubricants may contain as the only metal-containing additive component(s) thereof, a friction-modifying amount of one or more alkali or alkaline earth metal-containing additive components wherein the total concentration of such metal(s) in the finished gear oil is kept very low. That is, the total concentration of such metal(s) in the finished gear oil is at a maximum amount of about 25 ppm. When referring to the gear oil as being metal free, the presence of boron and phosphorous are not considered metals. Further, the invention allows for the omission of costly Mannich base and substituted succinimide-type dispersants.

DETAILED DESCRIPTION OF THE PREFERRED EMBODIMENTS

As used herein and in the claims, the term "percent by weight" means the percentage the recited component represents to the weight of the entire composition.

The present invention is directed to providing a clean performing lubricant useful as an automotive transmission gear oil and axle lubricant. The term "clean performing gear oil", as used herein, means that when the inventive gear oils are tested in the L-60-1 Test (described below), gears at the end of the test are relatively clean when compared to the gear oils formulated according to the prior art which do not contain functionalized PMA's according to the present invention.

A preferred finished gear oil, which is devoid of carboxylic-type ashless dispersants and Mannich base dispersants is generally composed of (a) a base oil or mixture of base oils to obtain the desired viscosity characteristics; (b) a functionalized PMA having VII and/or PPD properties as disclosed above; and (c) at least one gear performance additive. The gear performance additive is preferably an extreme pressure agent that is essentially metal-free and is at least 25 percent by weight sulfur, more preferably at least 30 percent by weight sulfur. The extreme pressure agent is present in the finished gear oil at a concentration sufficient to result in said gear oil containing 1,000 to 30,000 ppm sulfur from the extreme pressure agent. More preferably, the finished gear oil will contain 10,000 to 25,000 ppm sulfur from the extreme pressure agent and most preferably from 15,000 to 25,000 ppm sulfur.

In another embodiment, the present invention is directed to a gear oil essentially free of Mannich base and succinic-type dispersants that comprises: a) a base oil or a mixture of base oils; b) at least one functionalized PMA that possesses dispersant properties; and c) a metal free, extreme pressure agent that is at least 25 percent by weight sulfur.

According to the present invention, the finished gear oils have different primary viscosity grades which are indicated by the temperatures at which their Brookfield Viscosities are measured. That is, the Brookfield Viscosities of the finished gear oils as measured at minus 12, minus 26 and minus 40° C. have grades of "SAE 75W to 85W". At all grades, the Brookfield Viscosity ranges from about 1,000 to about 150,000 cP. The finished gear oil contains from about 88.0 to about 98.5 percent by weight of the base oil, the remainder being the functionalized PMA, the performance additive and other components.

Base Oils

Generally, the base oils useful in this invention may be formed from natural (e.g., mineral or vegetable oils) or synthetic base oils, or blends thereof However, the base oils should be primarily of the petroleum mineral oil type.

Suitable mineral oils include those of appropriate viscosity refined from crude oil of any source. Standard refinery operations may be used in processing the mineral oil. Among the general types of petroleum oils useful in the compositions of this invention are bright stocks, residual oils, hydrocracked base stocks, and solvent extracted naphthenic oils. Such oils and blends of them are produced by a number of conventional techniques which are widely known by those skilled in the art.

Among the suitable synthetic oils are homo- and interpolymers of $C_2$–$C_{12}$ olefins, carboxylic-type-acid esters of both monoalcohols and polyols, polyethers, silicones, polyglycols, silicates, alkylated aromatics, carbonates, thiocarbonates, orthoformates, phosphates and phosphites, borates, and halogenated hydrocarbons. Representative of such oils are homo- and interpolymers of $C_2$–$C_2$ monoolefinic hydrocarbons, alkylated benzenes (e.g., dodecyl benzenes, didodecycl benzenes, tetradecyl benzenes, dinonyl benzenes, di-(2-ethylhexyl)benzenes, wax-alkylated naphthalenes); and polyphenyls (e.g., biphenyls, terphenyls).

Alkylene oxide polymers and interpolymers and derivatives thereof where the terminal hydroxyl groups have been modified by esterification, etherification, etc., constitute a class of synthetic oils useful herein. These are exemplified by the oils prepared through polymerization of alkylene oxides such as ethylene oxide or propylene oxide, and the alkyl and aryl ethers of these polyoxyalkylene polymers,. For example, methyl polyisopropylene glycol ether having an average molecular weight of 1,000 and the diphenyl ethers of polyethylene glycol having a molecular weight of 500–1,000 are useful in this invention. The diethyl ethers of polypropylene glycol having a molecular weight of 1,000–1,500 or mono- and poly-carboxylic esters thereof are also useful.

Another suitable class of synthetic oils comprises the esters of dicarboxylic acids (e.g., phthalic acid, linoleic acid dimer) with a variety of alcohols such as but not limited to butyl alcohol, hexyl alcohol, and dodecyl alcohol. Specific examples of these esters include dibutyl adipate, dodecyl adipate, di-n-hexyl futmarate, and the complex ester formed by reacting one mole of sebacate acid with two moles of tetraethylene glycol and two moles of 2-ethylhexanoic acid.

Other esters which may be used include those made from $C_3$–$C_{18}$ monocarboxylic acids and polyols and polyol ethers such as neopentyl glycol, trimethylolpropane, pentaerythritol and dipentaeryfhntol. Trimethylol propane tripelargonate, pentaeryibritol tetracaproate, and the polyesters derived from a $C_4$–$C_{14}$ dicarboxylic-type acid and one or more aliphatic dihydric $C_3$–$C_{12}$ alcohols such as those derived from azelaic acid or sebacic acid and 2,2,4-trimethyl-1,6-hexanediol serve as examples.

Silicon-based oils such as the polyalkyl-,polyaryl-, polyalkoxy-, or polyaryloxy-siloxane oils and silicate oils comprise another class of synthetic lubricants, (e.g., tetraethyl silicate, tetraisopropyl silicate, and poly(methylphenyl)siloxanes) useful in the gear oil according to the invention.

Also useful as base oils or as components of base oils are hydrogenated or unhydrogenated liquid oligomers of $C_6$–$C_{16}$ α-olefins, such as hydrogenated or unhydrogenated oligomers formed from 1-decene.

Typical vegetable oils that may be used as base oils or as components of the base oils include castor oil, olive oil, peanut oil, corn oil, soybean oil, linseed oil, and the like. Such oils may be partially or fully hydrogenated, if desired.

According to the present invention, the base oil should have a viscosity that meets at least the viscometric requirements and a flash point temperature such that it will not contribute to the breakdown of the performance of the finished gear oil used in transmission or axle applications. Thus, the kinematic viscosity of a useful base oil at 100° C. will range from about 4.0 to about 41.0 cSt and the Viscosity Index will range from about 60 to about 140, preferably from 75 to 120. The flash point temperature of the base oil should range from about 200° to about 700° F., preferably from 300° to 600° F.

Functionalized PMA's

The functionalized PMA useful in the gear oil of this invention may be prepared by contacting a mixture consisting of the C1–C6 alkylmethacrylate (i), the C7–C14 alkyl methacrylate (ii), the C15–C20 alkylmethacrylate (iii) and the N,N-dialkylaminoalkyl(meth)acrylamide (iv) in the presence of a polymerization initiator-catalyst and chain transfer agent in an inert atmosphere in the presence of a diluent. In a more preferred embodiment, (i) is a C1–C4 alkylmethacrylate, (ii) is a C10–C14 alkylmethacrylate; and (iii) is C15–C20 alkylmethacrylate. Typically, 0 to 50 parts, preferably 0–25 parts and more preferably 10–25 parts of (i); and 30–85 parts, preferably 60–82 parts and more preferably 65–82 parts of (ii); and 3–50 parts, preferably 6–30 parts and more preferably 6–20 parts of (iii); and 2–10 parts, preferably 3–8 parts and more preferably 4–6 parts of (iv) are added to the reaction mixture.

The polymerization solvent may typically be an inert hydrocarbon, preferably a hydrocarbon lubricating oil which is compatible with or identical to the lubricating oil in which the gear oil package is to be employed. The amount of oil can be from 5–50 parts, preferably 20–50 parts and most preferably about 30–40 parts per 100 parts of polymerization reaction mixture.

The polymerization catalyst or initiator can be, for example, 2,2-azobisisobutylronitrile (AIBN) or a peroxide such as benzoyle peroxide. The amount of catalyst used can be readily determined by one skilled in the art. A chain terminator can be used and is typically a C8–C12 mercaptan, for example, lauryl mercaptan. The amount of chain terminator used can be readily determined by one skilled in the art.

Typically, the polymerizations are carried out with agitation at 25°–150° C., preferably 50–100° C. at 0 to 50 psig. The reaction time can range from about 1–8 hours. The reaction should be continued until two identical refractive indices are obtained from the reaction mixture. The number average molecular weight (Mn) of the functionalized PMA is from 20,000 to 500,000 preferably 50,000 to 150,000.

The present invention may take the form of a concentrate containing the functionalized PMA, extreme pressure agent, a diluent oil and optionally other additives such as demulsifers, pour point depressants, defoamers, rust inhibitors and the like.

In a preferred embodiment, the inventive gear oil is essentially devoid of conventional, ashless dispersants such as carboxylic-type ashless dispersants, Mannich base dispersants and the post-treated dispersants of these types. The carboxylic-type ashless dispersant that can be eliminated from the gear oil of this invention include the polyamine succinimides, the alkenyl succinic acid esters and diesters of alcohols containing 1–20 carbon atoms and 1–6 hydroxyl groups and the alkenyl succinic ester-amide mixtures.

One feature of the functionalized PMA's disclosed and used in this invention is that they have dispersant PPD properties (DPPD) and/or dispersant VII (DVII) properties. This is shown in the results of the L-60-1 oxidation performance test (described below) where the dispersancy as evidenced by the numbers for both the carbon/varnish and sludge ratings.

Commercially available functionalized PMA's which have been found to be effective in providing a clean gear oil that is useful in manual transmission oils and axle lubricants include those identified below by commercial name/code and (manufacturer; location):

TLA-706 (Ethyl Corporation; Richmond, Va.);
HiTEC® 5710 (Ethyl Corporation);
HiTEC® 5712 (Ethyl Corporation);
HiTEC® 5707 (Ethyl Corporation);
HiTEC® 5774 (Ethyl Corporation).
Acryloid 953 (Rohm & Haas; Philadelphia, Pa.)
Acryloid 953M (Rohm & Haas)
Acryloid 954 (Rohm & Haas)
Acryloid 958 (Rohm & Haas)
Acryloid 985 (Rohm & Haas)

Functionalized PMA's that are especially useful in the inventive gear oil are those of lower molecular weight (e.g., 5,000 to 50,000) which are also highly shear stable. Shear stability is important as the gear oil viscosity should not move out of a given range over the service life.

The level of functionalized PMA used is such that the finished gear oil has sufficient dispersancy to meet the requirements of the L-60-1 test (described below) which is a part of the API MT-1 gear oil specification.

The gear oil typically contains from about 0.1 to about 10.0 percent by weight, preferably from 0.5 to 3.0 percent by weight of the functionalized PMA.

As mentioned above, various other components, such as non-functionalized pour point depressants (PPD) and VII's can be used in combination with the functionalized PMA's making up the present gear oil. The PPD may be any oil soluble PPD material, e.g., a poly(alkylmethacrylate). The PPD lowers the 'pour point' of the finished gear oil.

Polyalkylmethacrylate pour point depressants comprising higher alkyl esters, e.g., those including 12 or more carbon atoms per alkyl group, are known. In U.S. Pat. No. 4,867,894 to Pennewiss et al., there is disclosed a poly (alkylmethacrylate) pour point depressant wherein from 10 to 30, preferably 10 to 20, mole percent methylmethacrylate is copolymerized with alkylmethacrylate monomers having relatively long, i.e., $C_{16}$ and higher, alkyl groups to form a pour point depressant additive. Pennewiss et al. teach that such an additive has a lower cost due to substitution of relatively low cost methyl methacrylate for a portion of relatively high cost higher alkyl esters and that, within the disclosed ranges of methyl methacrylate mole percent, such a substitution does not diminish the effectiveness of the additive as a PPD.

A useful non-functionalized PPD is Acryloid 3004 (manufactured by Rohm & Haas of Philadelphia, Pa.) which is a polymethacrylate. The amount of PPD used in the finished gear oil is generally about 0.2 to about 3.0 weight percent. Although Acryloid 3004 has been found to be effective, other non-functionalized PPD's may be used in the inventive gear oil. For example and not as a limitation, other PPD's that may be used in the present invention include those identified below by commercial name/code and (manufacturer; location):

Viscoplex I-330 (Rohn GmbH; HULS America Inc., Somerset, N.J.);
HiTEC® 5714 (Ethyl Corporation, Richmond, Va.);
HiTEC® 5788 (Ethyl Corporation);
TLA 664 (Ethyl Corporation); and
Acryloid 154 (Rohm & Haas; Philadelphia, Pa.).

Other components that may be used in the inventive gear oil include Dispersant olefin copolymers (DOCP). The DOCP's useful in the present invention may, for example, and not by limitation, be selected from the following products identified by commercial name/code and (manufacturer; location):

DOCP's
Castrol 731 (Castrol, N.A.; Los Angeles, Calif.);
Castrol 731X (Castrol, N.A.);
HiTEC® 6911 (Ethyl Corporation; Richmond, Va.);
HiTEC® 688 (Ethyl Corporation);
HiTEC® 693 (Ethyl Corporation);
HiTEC® 7575 (Ethyl Corporation);
HiTEC® 5755 (Ethyl Corporation); and
HiTEC® 5723 (Ethyl Corporation).

Gear Performance Additives

One aspect of the inventive gear oil that sets it apart from other lubricants is that it contains at least one extreme pressure (EP) agent that contains at least 25 percent by weight sulfur. The EP additive is preferably boron free and metal free (i.e., contains zinc) and is at least 30 percent by weight sulfur. The amount of said EP agent added to the gear oil will be sufficient to result in 1,000 to 30,000 ppm sulfur, more preferably 10,000 to 25,000 ppm sulfur and most preferably 15,000 to 25,000 ppm sulfur in the finished gear oil from the EP agent. These high levels of sulfur would be inappropriate for use in crankcase oils, hydraulic fluids, automatic transmissions and the like, due to oxidation and corrosion problems.

In general, the other gear performance additives are generally an ashless oil-soluble additive that provides a desired property to the finished gear oil. A gear performance additive package that has been found to be effective is HiTEC®-385 (manufactured and sold by Ethyl Corporation of Richmond, Va.) which contains a component of boron and a combination of sulfur and phosphorous containing materials which impart enhancing properties to the resulting gear oil. At an amount ranging from about 3.0 to about 10.0 percent by weight the gear performance additive, e.g., HiTEC®-385 is suitable to formulate gear oils for use in both axle and manual transmission lubricants. The gear oil additive useful herein is comprised of one or more components which enhance the performance of the gear oil. These enhanced features (i.e., properties) include:

Antiwear;
Extreme pressure performance;
Rust control;
Corrosion inhibition;
Antioxidation;

Foam inhibition;

Frictional inhibition; and (Optionally) Water separation.

Other gear oil performance additives that may be effective include the following, identified by commercial name/code and (manufacturer; location):

HiTEC® 381 (Ethyl Corporation; Richmond, Va.)

Anglamol 9000 (Lubrizol Corp.; Wickloffe, Ohio)

Anglamol 6043B (Lubrizol Corp.)

Anglamol 6043P (Lubrizol Corp.)

Anglamol 6043U (Lubrizol Corp.)

Mobilad 521 T (Mobil Oil; Princeton, N.J.)

The gear oil performance additive components, i.e., oil-soluble sulfur-containing antiwear and/or extreme pressure agent(s) used may be of low activity. Subject to this proviso, categories of materials in which suitable materials may exist include sulfurized olefins, sulfurized unsaturated fatty acids and/or esters, dihydrocarbyl polysulfides, trithiones, sulfrized thienyl derivatives, sulfurized terpenes, sulfurized oligomers of $C_2$–$C_8$ monoolefins, sulirized Diels-Alder adducts, and, in general, compounds which contain sulfur bound directly to carbon or to more sulfur. Specific examples of such materials include sulfurized triisobutylene, dicyclohexyl polysulfide, diphenyl polysulfide, dibenzyl polysulfide, dinonyl polysulfide, and mixtures of di-tert-butyl polysulfide such as mixtures of di-tert butyl trisulfide, di-tert-butyl tetrasulfide and di-tert-butyl pentasulfide, among others. Combinations of such categories of sulfur-containing antiwear and/or extreme pressure agents can also be used, such as a combination of sulfurized isobutylene and di-tert-butyl trisulfide, a combination of sulfurized isobutylene and dinonyl trisulfide, a combination of sulfurized tall oil and dibenzyl polysulfide, and the like.

Because of the toxicity of hydrogen sulfide, it is highly preferable, though not essential, to utilize in the practice of this invention oil-soluble sulfur-containing antiwear and/or extreme pressure agents, and more preferably oil-soluble active sulfur-containing antiwear and/or extreme pressure agents, that yield less than 25 ppm, and more preferably less than 10 ppm, of vapor space $H_2S$ when heated in the concentrated state for one week at 65° C. Most preferred are materials of this type which yield no detectable vapor space $H_2S$ when tested under these conditions.

From the most cost-effectiveness standpoint, the most preferred oil-soluble metal-free sulfur-containing antiwear and/or extreme pressure agents are the sulfurized olefins containing at least 30 percent by weight sulfur, the dihydrocarbyl polysulfides containing at least 25 percent by weight of sulfur, and mixtures of such sulfurized olefins and polysulfides are preferred. Of these materials, sulfurized isobutylenes having a sulfur content of at least 35 percent by weight of sulfur, and mixtures of such sulfurized olefins and polysulfides. Of these materials, sulfurized isobutylenes having a sulfur content of at least 35 percent by weight and a chlorine content, if any, of less than 0.2 percent by weight are especially preferred materials.

The total level of the gear performance additives in the gear oil can range from 1 to about 15 percent by weight. Preferably, the extreme pressure agent can comprise from 1.0 to about 10% by weight of the inventive gear oil.

Methods of preparing sulfiurized olefins are described in U.S. Pat. Nos. 2,995,569; 3,673,090; 3,703,504; 3,703,505; 3,796,661; and 3,873,454.

One soluble type of oil-soluble metal-free phosphorous- and nitrogen-containing antiwear and/or extreme pressure agent which can be employed in the practice of this invention is the phosphorous- and nitrogen-containing compositions of the type described in G.B. 1,009,913; G.B. 1,009,914; U.S. Pat. No. 3,197,405 and/or U.S. Pat. No. 3,197,496. In general, these compositions are formed by forming an acidic intermediate by the reaction of a hydroxy-substituted triester of a phosphorothioic acid with an inorganic phosphorous acid, phosphorous oxide or phosphorous halide, and neutralizing a substantial portion of said acidic intermediate with an amine or hydroxy-substituted amine.

It should be noted that the finished gear oil containing the preferred amount of suitable performance additives will contain about 500 to 2500 ppm phosphorous, 1000 to 30,000 ppm sulfur, and 0 to 500 ppm boron.

As disclosed above, the preferred gear oil according to this invention is essentially devoid of the conventional, ashless dispersants such as the carboxylic-type ashless dispersants, Mannich base dispersants and the post-treated dispersants of these types. In a most preferred embodiment, the gear oil of this invention is free of carboxylic-type ashless dispersants and Mannich base dispersants and comprises:

a) a base oil having a kinematic viscosity at 100° C. ranging from about 4.0 to about 41.0 cSt and a Viscosity Index ranging from about 60 to about 140;

b) a functionalized PMA, as described above; and c) at least one extreme pressure agent that contains at least 25 percent by weight sulfur. The gear oil may also contain additional performance additives such as rust control agents, corrosion inhibitors, antioxidants, foam inhibitors and water separation agents.

The finished gear oils to be used in the lubricants for transmissions and axles may be tested for their effectiveness by a well known oxidation performance test, i.e., L-60-1 as described below.

OXIDATION PERFORMANCE TEST: L-601

In providing a suitable gear oil, the L-60 test predecessor of L-60-1 Test has been used for many years to evaluate the oxidation performance of automotive axle and transmission oils. It is one of the tests present in the API-GL-5 classification for gear oils, and is also used in qualifying gear oils to the U.S. military specification, MIL-L-2105D.

The L-60 test as used may be generally described as to:

SCOPE: Determines the deterioration of lubricants under severe oxidation conditions.

METHOD: A measured sample of test oil is placed in a special gear case with two spur gears and a copper catalyst strip. The test is run for 50 hours, at 163° C., whilst the gears are being driven at 1725 rpm and air is being bubbled through the sample.

RESULTS: Viscosity increase and pentane and toluene insolubles are determined.

RATING: The gears are rated for carbon, varnish, and sludge deposits.

At the end of the test, a sample of the oxidized oil is evaluated for pentane and toluene insolubles (insolubles build up in the oil as a result of oxidation), and the rise in viscosity (viscosity of the oil tends to rise as a result of oxidation).

Over the past few years, a procedure has been established where, in addition to evaluating the oil in the L-60 test, the gears are also evaluated. As the oil oxidizes, there is a tendency for material to be deposited on the surface of the gears. The amount of deposit is rated with respect to carbon/varnish and with respect to sludge. Within the past year, the ASTM has improved the precision of the L-60 test which has subsequently been renamed the L-60-1 test. New specifications (API MT-1, MIL-PRF-2105E) have stipulated that the limits (i.e., rating) of these new features of carbon/varnish and of sludge are 7.5 MIN (minimum) and 9.4 MIN (minimum), respectively. The maximum percent viscosity rise has been specified to be 100, the pentane insolubles at 3 percent maximum and the toluene insolubles at 2 percent maximum.

The L-60-1 test procedure is practically identical to the L-60 test except that the conditions and parameters are more rigorously controlled in the industry. The Test Monitoring Center (TMC) records and reports the precision of each approved stand within the industry.

The relevance of the rating of the gear surfaces from the L-60-1 test is two-fold. Firstly, clean gears are used to market the lubricant as a positive feature as the industry moves to lubricants with improved oxidation and longer life. Pictures of the gears are often used in marketing the lubricant. Secondly, it is hypothesized in the industry that the deposits which build up on the shafts of the pinions of the gears during application cause an increase of friction with the seal and, thus, lead to premature seal erosion and even failure. It is, thus, important for both commercial and practical reasons to be able to market gear lubricant technology which exhibits enhanced performance in the L-60-1 test.

In order to show the advantages and effectiveness of the gear oils of this invention, blends of gear oils have been prepared with all or some of the components, i.e., additives, PPD VII's, DVII's and functionalized PMA's. These blends of finished gear oils were tested according to the L-60-1 test.

The components used in the finished gear oils as identified in Examples I–IV are described below:

Gear Additive A—containing sulfur, phosphorous and boron, respectively at about 23.0, 1.3, and 0.17 percent by weight, HiTEC® 385.

PPD—having a kinematic viscosity at 100° C. of about 85 cSt and a specific gravity of about 27, Acryloid 3004.

Base Oil I—having a kinematic viscosity at 100° C. of about 4.99 cSt, a Viscosity Index of about 100, a flash point temperature of about 398° F., and a refractive index of about 1.479.

Base Oil II—having a kinematic viscosity at 100° C. of about 31.4 cSt, a Viscosity Index of 90, a flash point temperature of about 555° F., and a refractive index of about 1.497.

DVII—a dispersant polymethacrylate, Acryloid 954.

The gear additive used in Examples I–IV was HiTEC® 385 and has the following general composition:

INGREDIENT

Sulfurized isobutylene

Phosphorous-containing anti-wear agents

Carboxylic-type ashless dispersants

Diluent oil

Corrosion inhibitors and other surface active agents

Thus, in these experiments, a carboxylic-type ashless dispersant was present in the evaluated gear oils.

Some aspects of this invention are illustrated by the following examples of blends of gear oils (i.e., Examples I through IV), and the results of the L-60-1 test are provided, respectively, below in TABLES I and II. The percentages are by weight unless otherwise specified, and the limits or ratings of the L-60-1 test results are indicated as maximum (MAX) or minimum (MIN).

EXAMPLES I–IV

The components of the blends of inventive gear oils (percent by weight) are included in TABLE I:

TABLE I

| | Gear Oils | | | |
|---|---|---|---|---|
| Component | I | II | III | IV |
| Gear Additive A HiTEC ® 385 | 7.50 | 7.50 | 7.50 | 7.50 |
| PPD (Acryloid 3004) | 2.00 | 0.50 | 1.00 | 0 |
| Base Oil I | 34.50 | 0 | 34.50 | 0 |
| Base Oil II | 56.00 | 92.00 | 56.00 | 92.00 |
| DVII (Acryloid 954) | 0 | 0 | 1.00 | 0.50 |

The results of the L-60-1 test of the gear oil blends of EXAMPLES I–IV are provided in TABLE II:

TABLE II

| | Results Of L-60-1 Test | | | |
|---|---|---|---|---|
| Result | I | II | III | IV |
| Viscosity Rise (%) | 78.5 | 97.2 | 58.4 | 84.7 |
| Pentane Insols (%) | 4.93 | 2.73 | 1.0 | 1.89 |
| Toluene Insols (%) | 2.11 | 2.01 | 0.80 | 1.25 |
| Carbon/Varnish | 7.2 | 6.0 | 9.4 | 9.0 |
| Sludge | 8.8 | 9.3 | 9.5 | 9.4 |

As shown above, Table II describes the results obtained when the four oils described in Table I are tested in the L-60-1 gear oil oxidation test. It can be seen that Gear Oil I contains no DVII, whereas, Gear Oil III contains 1.0 percent of DVII-Acryloid 954. The results in Table II show that Gear Oil III results in less viscosity rise, pentane insolubles and toluene insolubles compared to Gear Oil I. This indicates that the DVII in Gear Oil III gives rise to better oxidation control compared to that of Gear Oil I. In addition, the gear cleanliness ratings of carbon/varnish and sludge are higher (better) in the case of Gear Oil III than those of Gear Oil I. Improved gear cleanliness as seen in these L-60-1 tests is a very desirable feature for a gear lubricant as explained above.

Similarly, Table I provides a comparison of Gear Oils II and IV. Gear Oil IV contains DVII whereas Gear Oil II does not. The degree of oxidation of the Gear Oil II during the test is indicated by the rise in viscosity, the pentane insolubles, and the toluene insolubles shown in Table II. It can be seen that the Gear Oil IV with the DVII gives superior performance with respect to rise in viscosity, the pentane insolubles and the toluene insolubles as shown in Table II. In addition, Gear Oil IV also gives rise to greater gear cleanliness than Gear Oil II as shown by the higher (better) carbon/varnish and sludge ratings.

Therefore, Tables I and II clearly show the advantage of adding DVII to gear oils in the L-60-1 Test and are examples of one aspect of the present invention.

EXAMPLES V–VII

The following experiments were conducted to evaluate the use of the functionalized PMA's disclosed herein in gear oils that do not contain carboxylic-type ashless dispersants, Mannich base dispersants and the post-treated dispersants of these types.

Table III sets forth the composition of each experimental oil and a control gear oil.

TABLE III

| | Values in Percent by Weight | | | | |
|---|---|---|---|---|---|
| INGREDIENT | CONTROL | EX. V | EX. VI | EX VII | EX VIII |
| Gear Additive package | 4.3 | 4.3 | 4.3 | 4.3 | 4.3 |
| Functionalized PMA | 0. | 2.0 | 2.8 | 2.0 | 5.0 |
| Base Oil I | 76.48 | 74.88 | 74.24 | 74.88 | 72.48 |
| Base Oil II | 19.12 | 18.72 | 18.56 | 18.72 | 18.12 |
| Other minor components | 0.1 | 0.1 | 0.1 | 0.1 | 0.1 |

The gear additive package used in Examples V–VIII had the following composition:

INGREDIENT

Sulfurized isobutylene

Corrosion inhibitors

Mineral oil diluent

Phosphorous containing anti-wear agents

Thus, the gear oils of Examples V–VIII contained no conventional carboxylic-type ashless dispersants. One aspect of this invention resides in the cost savings associated with the selection of the conventional ashless dispersants from the gear oil formulations.

The functionalized PMA used in Example V contained about 10 percent by weight of the C1–C4 alkylmethacrylate (i), about 80 percent by weight of the C10–C14 alkylmethacrylate (ii), about 6 percent by weight of the C15–C18 alkylmethacrylate (iii), and about 4 percent by weight of the N,N-dialkylaminoalkyl(meth)acrylamide (iv). Table IV sets forth the functionalized PMA for each Example V–VIII.

TABLE IV

| | Functionalized PMA (Percent by weight) | | | |
|---|---|---|---|---|
| | EX V | EX VI | EX. VII | EX. VIII |
| C1–C4 (i) | 10 | 10 | 0 | 0 |
| C10–C14 (ii) | 80 | 80 | 65 | 65 |
| C15–C18 (iii) | 6 | 6 | 31 | 31 |
| N,N-acrylamide (iv) | 4 | 4 | 4 | 4 |

The L-60-1 test, as described above, was conducted on Examples V–VIII and the Control. Table V sets forth the percent viscosity increase, pentane insolubles, toluene insolubles and the carbon/varnish rating for each of the samples.

TABLE V

| | Results of L-60-1 Test | | | | |
|---|---|---|---|---|---|
| RESULT | CONTROL | EX V | EX VI | EX VII | EX VIII |
| Viscosity Rise - % | 31.12 | 52.66 | 49.06 | 36.67 | 13.77 |
| Pentane Insol - % | 1.67 | 2.67 | 0.41 | 0.55 | 0.26 |
| Toluene Insol - % | 1.14 | 1.78 | 0.33 | 0.53 | 0.24 |
| Carbon/Varnish | 1.09 | 7.50 | 9.33 | 8.4 | 8.4 |

These results demonstrate that the functionalized PMA used in Example VIII was extremely effective in preventing a viscosity increase in the gear oil. Further, the functionalized PMA used in Examples VI–VIII was very effective in keeping the pentane and toluene insoluble to a very low level compared to the Control. All of the oils formulated with functionalized PMA performed outstandingly in the carbon/varnish test.

When compared to the results set forth in Table II, wherein a conventional carboxylic-type ashless dispersant was used, it is evident that the gear oils from Examples V–VIII, as a whole, out-performed Examples I–IV, especially in keeping the percent viscosity increase to a minimum. Thus, the results obtained in this experiment support an embodiment of the invention wherein the gear oil containing the disclosed functionalized PMA's are essentially devoid of conventional carboxylic-type ashless dispersants.

The compositions of this invention preferably may contain at least one oil-soluble trihydrocarbyl dithiophosphate. This group of optional but preferred compounds is composed of O,O-dihydrocarbyl-S-hydrocarbyl thiothionophosphates (also known as O,O-dihydrocarbyl-S-hydrocarbyl phosphorothiothionates).

These compounds can be made by various known methods. Probably the most efficacious method involves reacting phosphorous pentasulfide ($P_2S_5$, often regarded as $P_4S_{10}$) with the appropriate alcohols or mixture of alcohols. Compounds in which one of the hydrocarbyl groups differs from the other two are preferably made by first reacting the phosphorous pentasulfide with an appropriate agent to form an intermediate product, viz, $(RO)_2PSSH$, which in turn is reacted with a compound containing at least one reactive olefinic double bond. See, in this connection, U.S. Pat. Nos. 2,528,732; 2,561,773; 2,665,295; 2,767,206; 2,802,856; 3,023,209, and *J. Org. Chem.*, 1963, 28, 1262–8.

Exemplary compounds suitable for use in the compositions of this invention include such compounds as trioctylphosphorothiothionate, tridecylphosphorothiothionate, trirlaurylphosphorothiothionate, O,O-diethyl bicyclo(2.2.1)-hepten-2-yl phosphorothiothionate, O,O-diethyl 7,7-dimethyl-bicyclo(2.2.1)-5-hepten-2-ylphosphorothiothionate, the product formed by reaction of dithiophosphoric acid-O,O-dimethyl ester with cis-endomethylene-tetrahydrophthalic acid dimethyl ester and the product formed by reaction of dithiophosphoric acid-O,O-dimethyl ester with cis-endomethylene-tetrahydrophthalic acid dibutyl ester.

Preferably, the finished gear oil compositions of this invention are ashless or low-ash compositions, that is, they contain, if any, at most 2,000 parts by weight of metal introduced from one or more of the additional components. More preferably, the finished gear oil contains no more than 500 ppm of metal, and most preferably zero to at most 25 ppm of metal. Accordingly, the additive concentrates of this invention are preferably proportioned such that if one or more metal-containing components (e.g., zinc dihydrocarbyldithiophosphate and/or metal detergent) are included therein, the additive concentrate when employed in a base oil at the selected or recommended dosage level will yield a finished lubricant having at most 2,000 ppm, preferably at most 500 ppm, and more preferably at most 25 ppm of added metal. When one or more metal additives are employed, the metal content thereof most preferably is confined to one or more alkali metals and/or one or more alkaline earth metals. Thus, for example, these particular preferred compositions are zinc-free. Compositions essentially devoid of added metal content are most especially preferred. In this connection, neither boron nor phosphorous is subject to these preferred limitations on metal content, as neither such element is considered a metal herein. Thus, the mere fact that boron and/or phosphorous components may leave residues during usage, is of no relevance as regards these preferred limitations on metal content.

Industrial Applicability

The automobile and heavy equipment industry is constantly searching for improved lubricating formulations for use in manual transmissions and axles. This invention provides an improved gear oil with enhanced oxidative stability, excellent dispersancy properties and kinematic viscosity. In a preferred embodiment, the gear according to the invention is essentially devoid of conventional carboxylic-type ashless dispersants, thus saving costs of materials and costs of production.

The disclosures of each patent or publication cited in the foregoing disclosure are incorporated herein by reference as if fully set forth herein.

While the preferred embodiments have been fully described and depicted for the purposes of explaining the principles of the present invention, it will be appreciated by those skilled in the art that modifications and changes may be made thereto without departing from the scope of the invention set forth in the appended claims.

What is claimed is:

1. An improved gear oil comprising:

a) a base oil having a kinematic viscosity at 100° C. ranging from about 4.0 to about 41.0 cSt and a Viscosity Index ranging from about 60 to about 140;

b) about 0.1 to about 10 percent by weight of a polymer comprising the following monomers:

(i) a C1–C6 alkylmethacrylate of the formula:

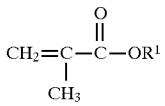

where $R^1$ is alkyl of 1 to 6 carbon atoms;

(ii) a C7–C14 alkylmethacrylate of the formula:

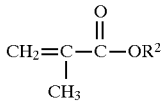

where $R^2$ is alkyl of 7 to 14 carbon atoms;

(iii) A C15–C20 alkylmethacrylate of the formula:

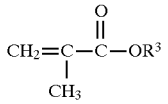

where $R^3$ is alkyl of 15–20 carbon atoms; and (iv) a N,N-dialkylaminoalkyl(meth)acrylamide of the formula:

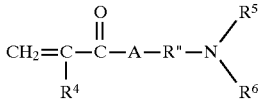

where $R^4$ is hydrogen or a lower alkyl group; $R^5$ or $R^6$ are hydrogen or a hydrocarbon selected from the group consisting of alkyl, aralkyl cycloalkyl, aryl and alkaryl, including such radicals when inertly substituted; R" is a hydrocarbon group selected from the group consisting of alkylene, aralkylene, cycloalkylene, arylene and alkarylene, including such radicals when inertly substituted; and A is selected from —O—, —S— and —NH—;

wherein said polymer comprises 0 to 50 percent by weight of said C1–C6 alkylmethacrylate, 30–85 percent by weight of said C7–C14 alkylmethacrylate, 3–50 percent by weight of said C15–C20 alkylmethacrylate and 2–10 percent by weight of said N,N dialkylaminoalkyl(meth)acrylamide and c) at least one gear performance additive.

2. The gear oil according to claim 1 wherein said gear performance additive is at least one extreme pressure agent that contains at least 25 percent by weight sulfur.

3. The gear oil according to claim 2 wherein said extreme pressure agent is present in said gear oil at a level to result in 1,000 to 30,000 ppm sulfur in said gear oil from said extreme pressure agent.

4. The gear oil according to claim 3 wherein said gear oil contains 10,000 to 25,000 ppm sulfur from said extreme pressure agent.

5. The gear oil according to claim 4 wherein said gear oil contains 15,000 to 25,000 ppm sulfur from said extreme pressure agent.

6. The gear oil according to claim 1 wherein $R^5$ and $R^6$ are selected from methyl, ethyl, n-propyl, i-propyl, butyls, amyls, hexyls, octyls, and decyls.

7. The gear oil according to claim 1 wherein said N,N-dialkylamninoalkyl(meth)acrylamide is selected from N,N-diethylaminopropylmethacrylamide and N,N-dimethylaminoethylacrylamide.

8. The gear oil according to claim 1 wherein said gear oil gear performance additive is at a concentration from 3.0 to 10 percent by weight.

9. The gear oil according to claim 1 wherein said gear oil has a Brookfield Viscosity at −12° C. ranging from 1,000 to 150,000 cP.

10. The gear oil according to claim 1 wherein said gear oil has a Brookfield Viscosity at −26° C. ranging from 1,000 to 150,000 cP.

11. The gear oil according to claim 1 wherein said gear oil is essentially devoid of carboxylic-type ashless dispersants.

12. The gear oil according to claim 1 wherein said gear oil is from 88.0 to 98.5 percent by weight of said base oil.

13. The gear oil according to claim 1 wherein said gear oil is essentially free of metal-containing additive components.

14. The gear oil according to claim 1 wherein said gear oil has a maximum concentration of metal of about 25 ppm.

15. The gear oil according to claim 1 wherein said polymer is at a concentration of 0.1 to 3.0 percent by weight.

16. The gear oil according to claim 1 wherein said base oil has a flash point temperature ranging from 200° to 700° F.

17. The gear oil according to claim 1 wherein $R^5$ and $R^6$ are selected from methyl, ethyl, n-propyl, isopropyl, n-butyl, isobutyl, sec-butyl, amyl, octyl, decyl, octadecyl, benzyl, beta-phenylethyl, cyclohexyl, cycloheptyl, cyclooctyl, 2-methylcycloheptyl, 3-butylcyclohexyl, 1,3-methlcyclohexyl, tolyl, xylyl, 2-ethoxyethyl, carboethoxymethyl and 4-methylcyclohexyl.

18. A lubricant essentially devoid of carboxylic ashless dispersants comprising:

a) a base oil having a kinematic viscosity at 100° C. ranging from about 4.0 to about 41.0 cSt and a Viscosity Index ranging from about 60 to about 140;

b) a dispersant Viscosity Index Improver at a concentration of from 0.1 to 10.0 percent by weight; and c) a gear performance additive at a concentration of from 3.0 to 10 percent by weight and wherein said additive is at least one extreme pressure agent containing at least 25 percent by weight sulfur; and wherein the resulting lubricant has a Brookfield Viscosity at −12° C. ranging from about 1,000 to about 150,000 cP.

19. The lubricant according to claim 18 wherein said resulting lubricant has a Brookfield Viscosity at −26° C. ranging from about 1,000 to about 150,000 cP.

20. The lubricant of claim 18 wherein said lubricant comprises from about 0.1 to about 3.0 percent by weight of said dispersant Viscosity Index Improver.

21. The lubricant of claim 18 additionally comprising a dispersant pour point depressant.

22. The lubricant of claim 18 wherein said lubricant contains from about 88.0 to about 98.5 percent by weight of said base oil.

23. A method for reducing the carbon and varnish production in a lubricated axle or manual transmission, said method comprising the use of a gear oil comprising:

a) a base oil in the amount of about 88.0 to about 98.5 percent by weight, said base oil having a kinematic viscosity at 100° C. ranging from about 4.0 to about 41.0 cSt and a Viscosity Index ranging from about 60 to about 140;

b) about 0.1 to about 10 percent by weight of a polymer comprising the following monomers:

(i) a C1–C6 alkylmethacrylate of the formula:

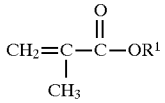

where $R^1$ is alkyl of 1 to 6 carbon atoms;

(ii) a C7–C14 alkylmethacrylate of the formula:

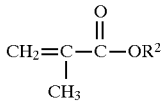

where $R^2$ is alkyl of 7 to 14 carbon atoms;

(iii) A C1–C20 alkylmethacrylate of the formula:

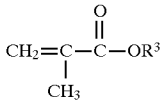

where $R^3$ is alkyl of 15–20 carbon atoms; and (iv) a N,N-dialkylaminoalkyl(meth)acrylamide of the formula:

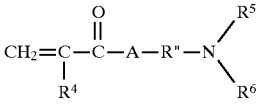

where $R^4$ is hydrogen or a lower alkyl group; $R^5$ or $R^6$ are hydrogen or a hydrocarbon selected from the group consisting of alkyl, aralkyl cycloalkyl, aryl and alkaryl, including such radicals when inertly substituted; R" is a hydrocarbon group selected from the group consisting of alkylene, aralkylene, cycloalkylene, arylene and alkarylene, including such radicals when inertly substituted; and A is selected from —O—, —S— and —NH—;

wherein said polymer comprises 0 to 50 percent by weight of said C1–C6 alkylmethacrylate, 30–85 percent by weight of said C7–C14 alkylmethacrylate, 3–50 percent by weight of said C15–C20 alkylmethacrylate and 2–10 percent by weight of said N,N dialkylaminoalkyl(meth)acrylamide and c) about 0.1 to 10 percent by weight of an extreme pressure agent containing at least 25 percent by weight sulfur.

24. A lubricant comprising:

a) a base oil in the amount of about 88.0 to about 96.0 percent by weight, said base oil having a kinematic viscosity at 100° C. of about 4.0 to about 41.0 cSt and a Viscosity Index ranging from about 60 to about 140;

b) a dispersant pour point depressant in the amount of about 0.1 to about 3.0 percent by weight; and c) a gear performance additive in the amount of about 3.0 to about 10.0 percent by weight and wherein said additive is at least one extreme pressure agent containing at least 25 percent by weight sulfur; and wherein the resulting lubricant has a Brookfield viscosity at −12° C. ranging from about 1,000 up to about 150,000 cP.

25. The lubricant according to claim 24 wherein said resulting lubricant has a Brookfield Viscosity at −26° C. ranging from about 1,000 up to about 150,000 cP.

26. The lubricant according to claim 24 wherein said lubricant is essentially free of carboxylic-type ashless dispersants.

27. A gear oil comprising:

a) a base oil having a kinematic viscosity at 100° C. ranging from about 4.0 to about 41.0 cSt and a Viscosity Index ranging from about 60 to about 140;

b) a combination of a dispersant pour point depressant and a dispersant Viscosity Index Improver, said combination being at a concentration for 0.1 to 3.0 percent by weight; and c) at least one extreme pressure agent at a concentration from 3.0 to 10 percent by weight and wherein said extreme pressure agent is at least 30 percent by weight sulfur; and wherein the resulting gear oil has a Brookfield Viscosity at −12° C. ranging from about 1,000 to about 150,000 cP.

28. The gear oil according to claim 27 wherein said gear oil is essentially free of carboxylic-type ashless dispersants and Mannich base dispersants.

29. The gear oil according to claim 28 wherein said gear oil contains from about 88.0 to about 98.5 percent by weight of said base oil.

30. The gear oil according to claim 28 wherein said gear oil comprises from about 1.0 to about 3.0 percent by weight of said combination of said dispersant pour point depressant and dispersant Viscosity Index Improver.

31. A gear oil having a Brookfield Viscosity at −12° C. or −26° C. ranging from about 1,000 up to about 150,000 cP, said gear oil comprising:

a) a base oil in the amount of about 88.0 to about 98.5 percent by weight; said base oil having a kinematic viscosity at 100° C. of about 4.0 to about 41.0 cSt and a Viscosity Index ranging from about 60 to about 140;

b) a functionalized poly(meth)acrylate (PMA) in the amount of about 0.1 to about 3.0 percent by weight; and c) a gear performance additive containing at least 25 percent by weight sulfur in the amount of about 3.0 to about 10.0 percent by weight.

32. The gear oil of claim 31 wherein said gear oil contains about 500 to 2500 ppm phosphorous, about 1000 to 30,000 ppm sulfur and about 0 to 500 ppm boron.

33. The gear oil of claim 32 wherein said gear performance additive is an ashless oil-soluble additive and contains at least 30% by weight sulfur.

34. The gear oil of claim 33 wherein said gear oil is essentially free of carboxylic-type ashless dispersants.

35. The gear oil of claim 34 wherein said gear oil has a maximum concentration of metal of about 25 ppm.

36. A method for reducing the sludge production in a lubricated gear box or axle comprising adding to said gear box or axle:

a) a base oil in the amount of about 88.0 to about 96 percent by weight, said base oil having a kinematic viscosity at 100° C. ranging from about 4.0 to about 41.0 cSt and a Viscosity Index ranging from about 60 to about 140;

b) about 0.1 to about 10 percent by weight of a polymer comprising the following monomers:

(i) a C1–C6 alkylmethacrylate of the formula:

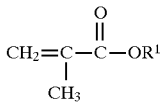

where $R^1$ is alkyl of 1 to 6 carbon atoms;

(ii) a C7–C14 alkylmethacrylate of the formula:

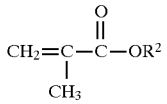

where $R^2$ is alkyl of 7 to 14 carbon atoms;

(iii) A C15–C20 alkylmethacrylate of the formula:

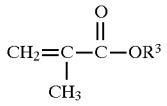

where $R^3$ is alkyl of 15–20 carbon atoms; and (iv) a N,N-dialkylaminoalkyl(meth)acrylamide of the formula:

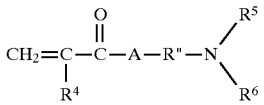

where $R^4$ is hydrogen or a lower alkyl group; $R^5$ or $R^6$ are hydrogen or a hydrocarbon selected from the group consisting of alkyl, aralkyl cycloalkyl, aryl and alkaryl, including such radicals when inertly substituted; R" is a hydrocarbon group selected from the group consisting of alkylene, aralkylene, cycloalkylene, arylene and alkarylene, including such radicals when inertly substituted; and A is selected from —O—, —S— and —NH—; and wherein said polymer comprises 0 to 50 percent by weight of said C1–C6 alkylmethacrylate, 30–85 percent by weight of said C7–C14 alkylmethacrylate, 3–50 percent by weight of said C15–C20 alkylmethacrylate and 2–10 percent by weight of said N,N dialkylaminoalkyl(meth)acrylamide and c) about 0.1 to 10 percent by weight of an extreme pressure agent containing at least 25% by weight sulfur.

* * * * *